US006334546B1

(12) United States Patent
Wang

(10) Patent No.: US 6,334,546 B1
(45) Date of Patent: Jan. 1, 2002

(54) BALL CARTRIDGE MEANS FOR STORING, DELIVERING AND COLLECTING PRACTICE BALL

(76) Inventor: Austin Wang, 3F-1, No. 215, Cheng-Teh Road, Sec. 2, Taipei (TW)

( * ) Notice: Subject to any disclaimer, the term of this patent is extended or adjusted under 35 U.S.C. 154(b) by 0 days.

(21) Appl. No.: 09/620,763

(22) Filed: Jul. 21, 2000

(51) Int. Cl.[7] ..... B65H 1/00
(52) U.S. Cl. ..... 221/197; 221/287
(58) Field of Search ..... 221/197, 287, 221/174, 199

(56) References Cited

U.S. PATENT DOCUMENTS 4,676,397 A * 6/1987 Hoffmeister ..... 221/199 X
6,050,448 A * 4/2000 Willis ..... 221/197
6,098,839 A * 8/2000 Hunnell ..... 221/197
6,193,102 B1 * 2/2001 Bevirt et al. ..... 221/197 X

* cited by examiner

*Primary Examiner*—David H. Bollinger

(57) ABSTRACT

A ball cartridge device includes: a tube container for filling practice balls in the tube container having a locking bar resiliently held in a bottom portion of the tube container for normally preventing discharge of ball from the container, and a discharge tube formed on an unloading device and positioned under the tube container for quickly coupling the tube container for smoothly discharging ball from the tube container through the unloading device to a ball dispensing device.

7 Claims, 5 Drawing Sheets

BALL CARTRIDGE MEANS FOR STORING, DELIVERING AND COLLECTING PRACTICE BALL

BACKGROUND OF THE INVENTION

U.S. Pat. No. 5,549,518 issued to the same inventor of this application disclosed a golf ball dispensing device for gravitationally discharging golf ball to a tee. It includes a hopper for loading golf ball into the housing of the dispensing device. However, it can not be compatible with a ball cartridge including a tube container or the so-called "easy tube" (commercial name) having a plurality of practice balls filled in the tube.

The present inventor has invented a ball cartridge device for a quick coupling with the ball dispensing device for conveniently supplying practice balls into the dispensing device.

SUMMARY OF THE INVENTION

The object of the present invention is to provide a ball cartridge device including: a tube container for filling practice balls in the tube container having a locking bar resiliently held in a bottom portion of the tube container for normally preventing discharge of ball from the container, and a discharge tube formed on an unloading device and positioned under the tube container for quickly coupling the tube container for smoothly discharging ball from the tube container through the unloading device to a ball dispensing device.

DETAILED DESCRIPTION

Figure 1:
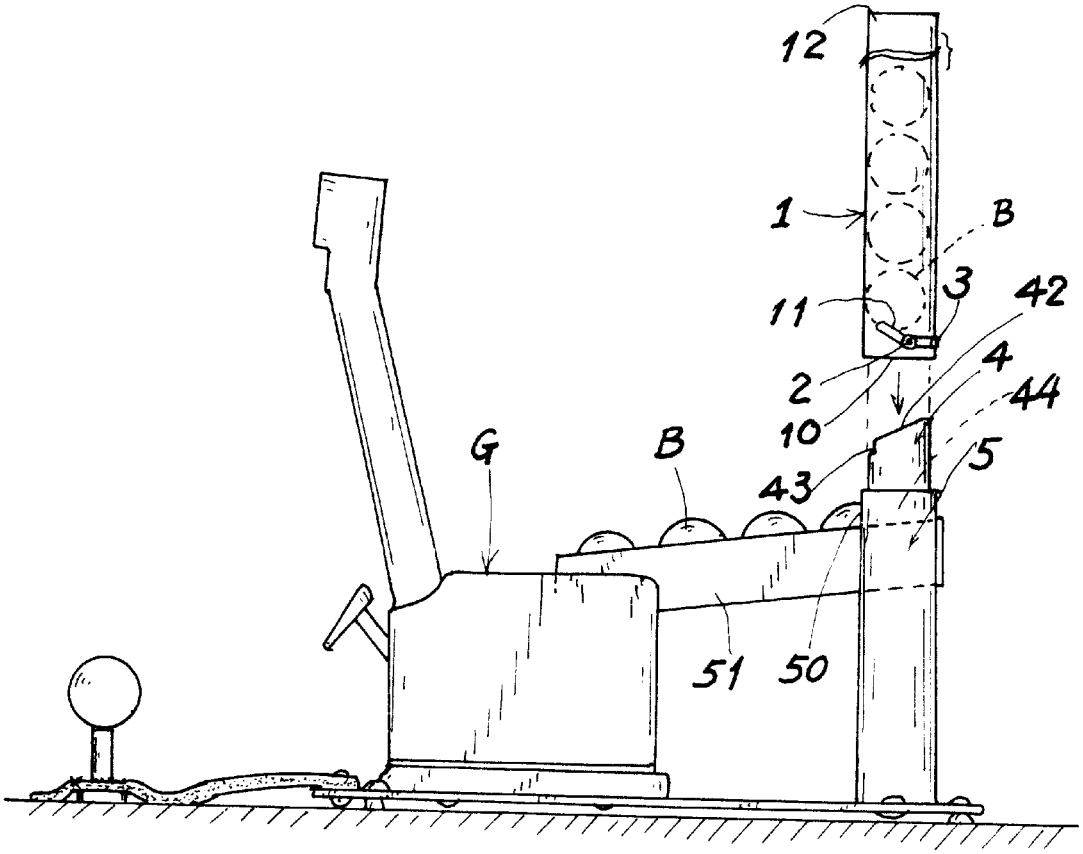
FIG. 1 is an illustration of the present invention connected with a ball dispensing device.
Figure 2:
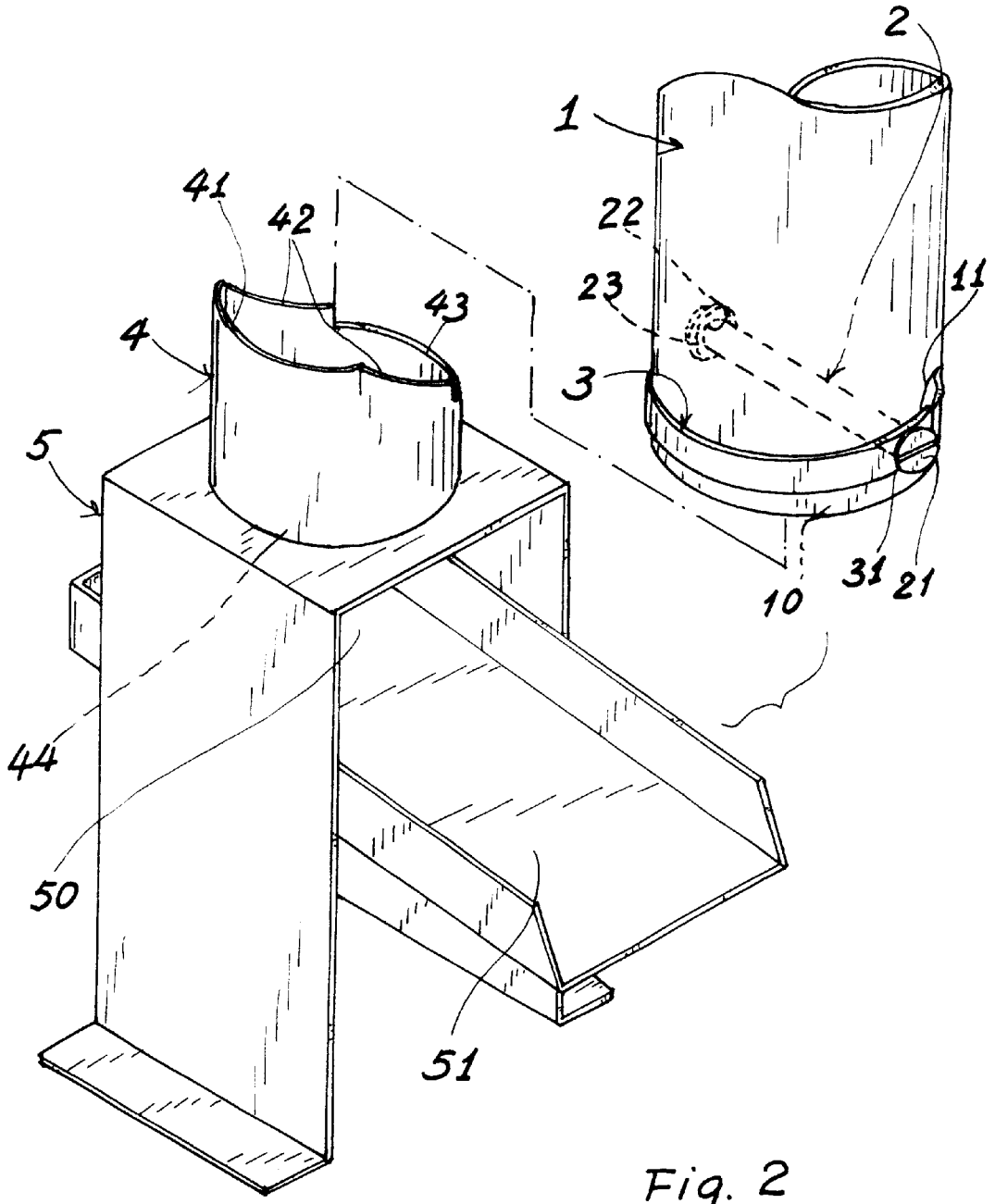
FIG. 2 is a perspective view showing the elements of the present invention.

As shown in FIGS. 1~5, the present invention comprises: a tube container 1, a locking bar 2 transversely resiliently held in a bottom portion of the tube container 1 by a restoring fastener 3, a discharge tube 4 coupled with the tube container 1, and an unloading means 5 secured with the discharge tube 4.

The unloading means 5 is connected to a ball dispensing device such as a golf ball dispensing device of U.S. Pat. No. 5,549,518 if provided for practicing golf ball.

Naturally, the tube container 1 itself may also be used individually or independently for storing or pick-up of practice balls therein.

The balls used in this invention are not limited. For instance, golf ball, baseball, tennis and the other balls may be played by using the present invention.

The tube container 1 is formed as a cylindrical shape, and includes: a bottom opening 10, a pair of slots 11 circumferentially formed in opposite cylindrical wall portions of the tube container 1, and a top opening 12.

The locking bar 2 is transversely inserted through and slidably held in the two slots 11 formed in the tube container 1; and includes: a head portion 21 disposed outside a first slot 11, a threaded portion 22 formed on an end portion of the bar 2 opposite to the head portion 21 and disposed outside a second slot, and a nut 23 engaged with the threaded portion 22 for limiting the bar 2 without separation from the tube container 1.

The restoring fastener 3 has its two fixing ends 31 respectively secured with two opposite end portions of the bar 2 and disposed around a cylindrical surface of the tube container 1 for resiliently fastening the locking bar 2 on the tube container 1. The restoring fastener 3 may be selected from rubber band, spring or any other elastomers or materials having elasticity and flexibility.

The tube container 1 has an inside diameter D larger than a diameter Db of the ball B filled or stored in the tube container 1.

Figure 4:
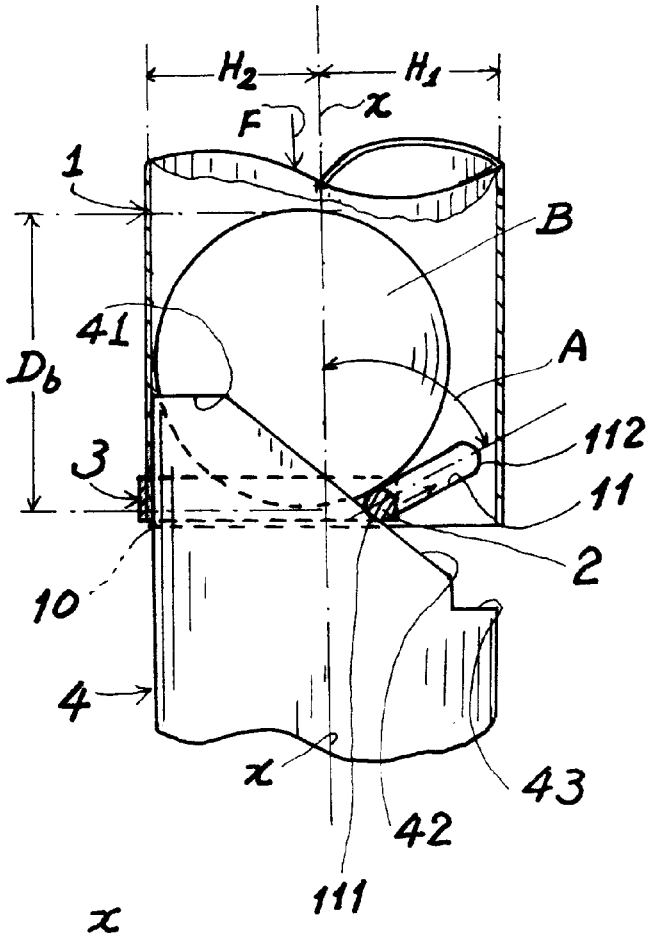
FIG. 4 is a sectional drawing showing the tube container to be coupled with the discharge tube of the present invention.

Each slot 11 is inclined slightly upwardly sidewardly from a first slot end 111 (near an axis X of a center of the tube container) towards a second slot end 112 (distal from the axis X of the tube container 1). Each slot 11 projectively defines an acute angle A with the axis X (FIG. 4).

Figure 3:
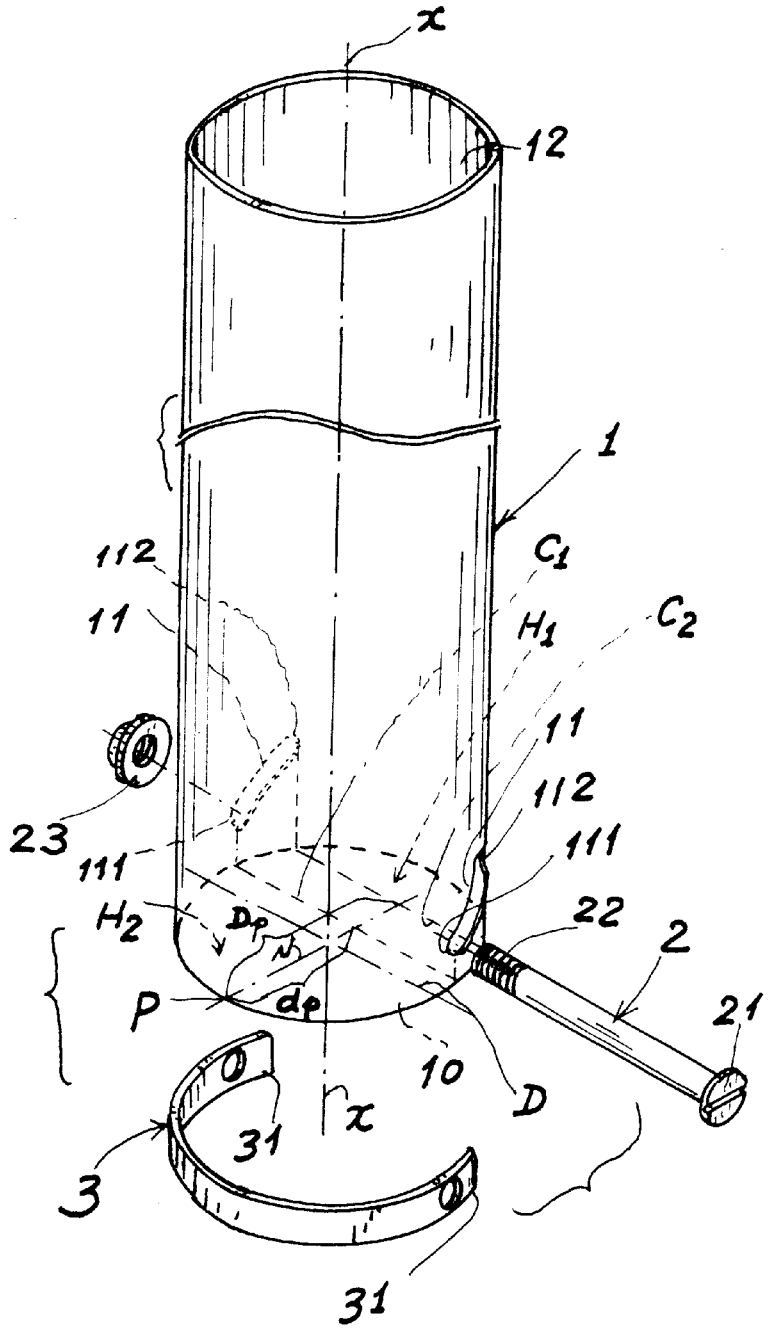
FIG. 3 shows the tube container and its relevant elements of the present invention.
Figure 5:
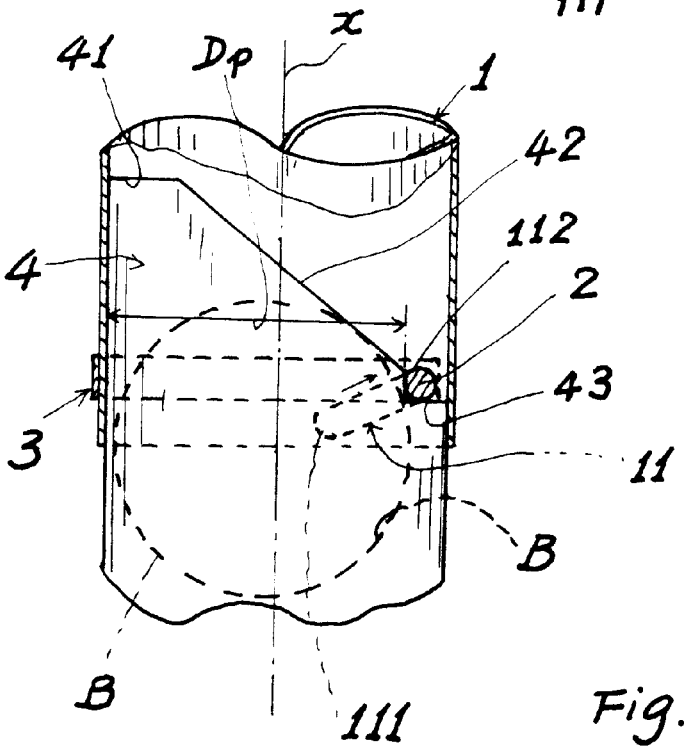
FIG. 5 shows the tube container coupled with the discharge tube following FIG. 4.

A first chord C1 defined between the two first slot ends 111 of the two slots 11 (FIGS. 3, 4) is eccentric to the diameter D of the tube container 1; while a second chord C2 between the two second slot ends 112 defining a "normal-line" distance Dp between the second chord C2 and an apex P at a perimeter of the tube container and intersecting with a normal line N perpendicular to the second chord C2 and aligned with the axis X. The normal-line distance Dp should be larger than the diameter Db of the practice ball B to allow a downward discharge of the ball from the tube container 1 towards the discharge tube 4 as shown in FIGS. 3, 5.

A distance dp from the first chord C1 to the apex P is larger than half diameter ½D, but smaller than a diameter Db of the ball B for normally retaining the ball in the tube container.

The two slots 11 are formed in the cylindrical wall of the tube container 1 as disposed in an opened semi cylinder H1 (FIGS. 4, 3) for transversely holding the locking bar 2 in the opened semi cylinder H1; while the restoring fastener 3 is majorly fastened on the cylindrical wall of the tube container 1 as disposed in a closed semi cylinder H2 opposite to the opened semi cylinder H1.

The designation of "opened semi cylinder H1" may refer to the partial cylindrical wall of the tube container 1 which is "opened" as cut with two slots 11 therethrough; while the "closed semi cylinder H2" is designated as "closed" since there is no slot cut out therethrough.

The discharge tube 4 is also formed as cylindrical shape having an outside diameter slightly smaller than an inside diameter D of the tube container 1 for engageably coupling the discharge tube 4 within the tube container 1 (FIG. 5).

The discharge tube 4 includes: a ridge portion 41 adjacent to the closed semi cylinder H2, a sloping-surface portion 42 inclined downwardly from the ridge portion 41 at the closed semi cylinder H2 towards the opened semi cylinder H1 to projectively intersect the slots 11 cut in the tube container 1, a bar recess 43 recessed in a lower portion of the sloping-surface portion 42 opposite to the ridge portion 41, and a bottom opening 44 formed at a bottom of the discharge tube 4.

The discharge tube 4 is secured on the unloading means 5 which includes a discharge opening 50 communicated with the bottom opening 44 of the discharge tube 4 for discharging ball B from the tube container 1, the discharge tube 4 towards a sloping trough 51 formed under the discharge tube 4 for delivering ball B to a ball dispensing device G as shown in FIG. 1.

The tube container 1 is coupled on the discharge tube 4 by inserting the discharge tube 4 into the tube container 1 (the discharge tube 4 having an outside diameter slightly smaller than an inside diameter of the tube container 1) as shown in FIGS. 4, 5, and the locking bar 2 will be thrusted sidewardly (rightwardly as shown in FIG. 5) by the sloping-surface portion 42 upon a downward depression (F) of the tube container 1 towards the discharge tube 4 until the locking bar 2 is thrusted into the bar recess 43 to be stably engaged with the bar recess 43. The restoring fastener 3 is provided for fastening the locking bar 2, the discharge tube 4 and the tube container 1 together at their coupling condition.

The bar 2 is moved sidewardly (unlocked) to allow the ball B to drop from the upper tube container 1 toward the lower discharge tube 4 to be delivered to the ball dispensing device or a playing place for ball practice.

Figure 6:
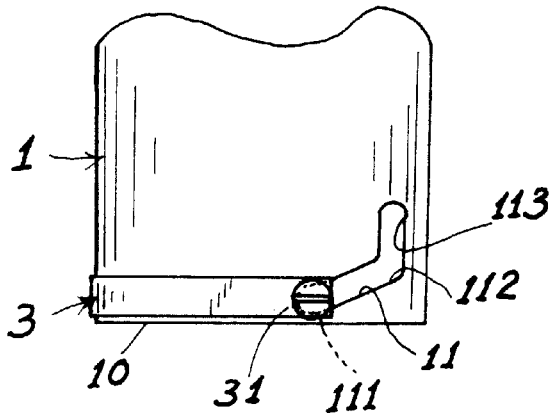
FIG. 6 shows another modification of the tube container of the present invention.

The slot 11 further includes a vertical slot section 113 as shown in FIG. 6 as vertically extended from a second end 112 of the slot 11, whereby upon a further downward movement of the upper tube container 1 toward the lower discharge tube 4, the locking bar 2 will be engaged into the vertical slot section 113 for a more stable engagement of the bar 2 in the slot 113, thereby stabilizing the coupling of the tube container 1 with the discharge tube 4.

The tube container 1 may be used individually and independently for collecting or storing balls B therein.

Figure 7:
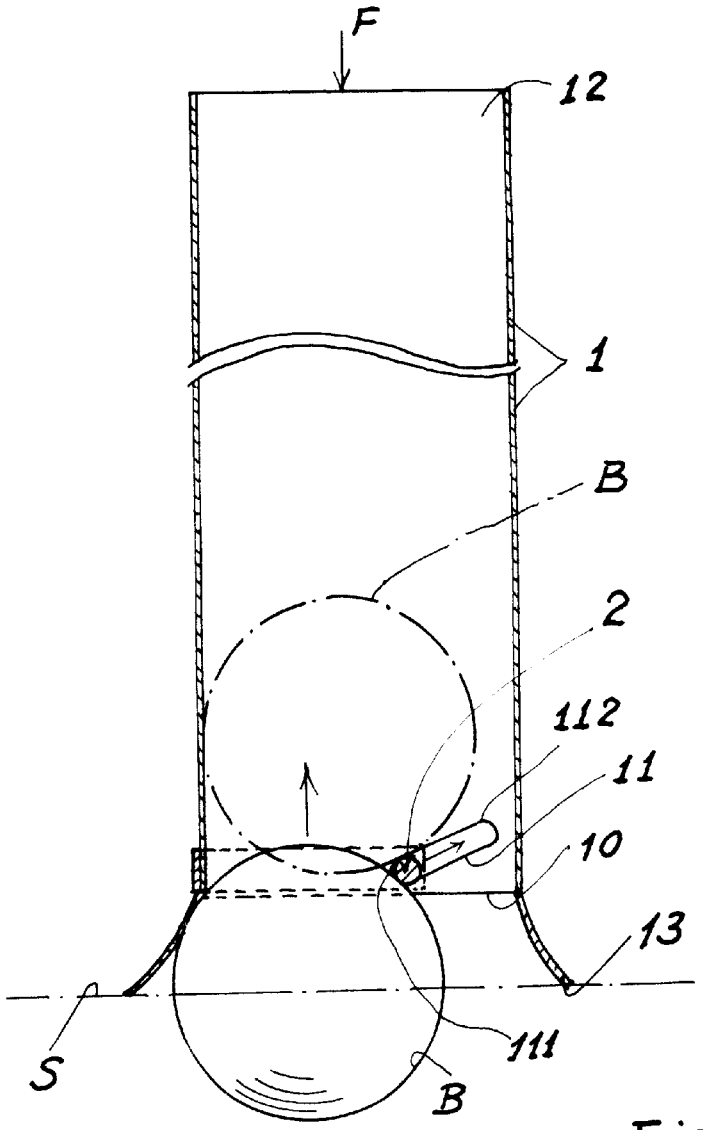
FIG. 7 shows still another preferred embodiment of the tube container of the present invention.

As shown in FIG. 7, the tube container 1 further includes a skirt portion 13 formed or secured on a bottom of the tube container 1 and diverging downwardly radially to serve as a guide for smoothly guiding and collecting the ball B upwardly from the bottom opening 10 into the tube container as arrow direction shown in FIG. 7 by upwardly sidewardly thrusting the locking bar 2; or to serve as a supporting base to stably stand on a surface S as dotted line shown in FIG. 7.

Upon disengagement of the tube container 1 from the discharge tube 4, the restoring fastener 3 will restore the locking bar 2 downwardly centripetally to be rested on the first (lower) end 111 of the slot 11 to limit the ball B and prevent dropping of ball from the bottom opening 10.

The present invention provides a ball cartridge for quickly coupling a discharge tube of an unloading means for supplying ball quickly and conveniently.

The present invention may be modified without departing from the spirit and scope of the present invention.

Figure 3A:
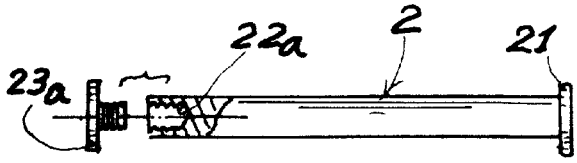
FIG. 3*a* shows another modified locking bar of this invention.

As shown in FIG. 3*a,* the locking bar 2 may be modified to include: a head portion 21 formed on a first end of the bar, a female recess 22*a* recessed in a second end of the bar, and a plug 23*a* plugged in the female recess 22*a* to limit the bar 2 on the tube container 1.

I claim:

1. A ball cartridge means for storing and delivering practice ball comprising:

a tube container formed as cylindrical shape having a top opening and a bottom opening respectively formed on a top and a bottom of the container for filling a plurality of balls therein, and including:

a pair of slots circumferentially formed in opposite cylindrical wall portions of the tube container; and said locking bar transversely inserted through and slidably held in the two slots formed in the tube container;

a locking bar resiliently held in a bottom portion of said tube container and fastened on the tube container by a restoring fastener for normally retaining the balls within the container without dropping through the bottom opening as limited by said locking bar;

a discharge tube secured on an unloading means and positioned under said tube container and communicated with said bottom opening of said tube container; said discharge tube including: a ridge portion, a sloping-surface portion inclined downwardly from the ridge portion to projectively intersect the slots as cut in the tube container, a bar recess recessed in a lower portion of the sloping surface portion opposite to the ridge portion, and a bottom opening formed at a bottom of the discharge tube; whereby upon coupling of said tube container on said discharge tube by downwardly depressing said tube container on said discharge tube, said locking bar is sidwardly thrusted by said sloping-surface portion of said discharge tube to unlock the locking bar to allow the balls to drop from the tube container into said discharge tube, and the balls will be delivered to a ball dispensing device through said discharge tube and said unloading means.

2. A ball cartridge means according to claim 1, wherein said unloading means includes a discharging opening communicated with said bottom opening of said discharge tube, and a sloping trough positioned under said discharge tube and connectable to said ball dispensing device, whereby upon discharge of balls from said discharge tube and said tube container, the balls will be delivered through said discharge opening and said trough towards the ball dispensing device.

3. A ball cartridge means according to claim 1, wherein said locking bar includes: a head portion disposed outside one said slot, a threaded portion formed on an end portion of the bar adjacent to the other slot and opposite to the head portion, and a nut engaged with the threaded portion for limiting the bar without separation from the tube container.

4. A ball cartridge means according to claim 1, wherein said locking bar includes: a female recess formed in one end of said bar, and a plug plugged in the female recess for limiting the bar on the tube container.

5. A ball cartridge means according to claim 1, wherein said restoring fastener has two fixing ends thereof respectively secured with two opposite end portions of the locking bar and disposed around a cylindrical surface of the tube container for resiliently fastening the locking bar on the tube container, said restoring fastener selected from a rubber band, a spring and an elastomer having elasticity and flexibility.

6. A ball cartridge means according to claim 1, wherein each said slot further includes a vertical slot section vertically extended from an end of the slot, whereby upon a further downward depression of the tube container toward the discharge tube, the locking bar is engaged into the vertical slot section for a more stable engagement of the bar in the slot for stabilizing the coupling of the tube container with the discharge tube.

7. A ball cartridge means according to claim 1, wherein said tube container has an inside diameter larger than a diameter of the ball; each said slot inclined sidewardly upwardly from a first slot end proximal to an axis of said tube container towards a second slot end distal from the axis of said tube container, each said slot projectively defining an acute angle from the axis; and said tube container having an inside diameter slightly larger than an outside diameter of said discharge tube.

* * * * *